US006934995B2

(12) United States Patent
Wheeler et al.

(10) Patent No.: US 6,934,995 B2
(45) Date of Patent: Aug. 30, 2005

(54) HAND HELD STEAM VACUUM WITH SINGLE SWITCH OPERATION

(75) Inventors: David K. Wheeler, Ganaoque (CA); David M. Shaver, Brockville (CA)

(73) Assignee: Black & Decker Inc., Newark, DE (US)

( * ) Notice: Subject to any disclaimer, the term of this patent is extended or adjusted under 35 U.S.C. 154(b) by 424 days.

(21) Appl. No.: 10/175,516

(22) Filed: Jun. 19, 2002

(65) Prior Publication Data

US 2003/0233727 A1 Dec. 25, 2003

(51) Int. Cl.[7] ..... A47L 5/24; A47L 11/30
(52) U.S. Cl. ..... 15/344; 15/320
(58) Field of Search ..... 15/320, 344; 392/402–406

(56) References Cited

U.S. PATENT DOCUMENTS

| | | | |
|---|---|---|---|
| 2,020,120 | A | 11/1935 | Leathers |
| 2,617,138 | A | 11/1952 | Brown, Sr. et al. |
| 3,040,362 | A | 6/1962 | Krammes |
| 3,245,160 | A | 4/1966 | Knapp |
| 3,604,037 | A | 9/1971 | Varner |
| 3,675,449 | A | 7/1972 | Bluestein |
| RE27,792 | E | 10/1973 | Howerin et al. |
| D231,658 | S | 5/1974 | Stauft |
| 3,869,749 | A | 3/1975 | London et al. |
| 3,940,826 | A | 3/1976 | Phillips et al. |
| 3,949,499 | A | 4/1976 | Schaeffer et al. |
| 4,046,989 | A | 9/1977 | Parise et al. |
| 4,327,459 | A | 5/1982 | Gilbert |
| 4,397,057 | A | 8/1983 | Harbeck |
| 4,536,914 | A | 8/1985 | Levine |
| 4,583,260 | A | 4/1986 | Zai |
| D289,576 | S | 4/1987 | Okada et al. |
| 4,656,763 | A | 4/1987 | Kawasaki et al. |
| 4,788,769 | A | 12/1988 | Maruyama |

(Continued)

FOREIGN PATENT DOCUMENTS

| | | | |
|---|---|---|---|
| JP | 2-191498 | A | 7/1990 |

OTHER PUBLICATIONS

Black & Decker Home Products Catalog; 1999; 6 Pages.

*Primary Examiner*—Terrence R. Till
(74) *Attorney, Agent, or Firm*—Harness, Dickey & Pierce, P.L.C.

(57) ABSTRACT

A hand held steam vacuum is provided that is operated by way of a single switch device. The vacuum is generally comprised of a vacuum fan, a water pump, a heating element, and a fluid supply tank in fluid communication with a fluid discharge outlet. In operation, the vacuum fan is operable to suck debris into a collection bowl residing in the vacuum. In addition, the water pump is operable to drive fluid from the fluid supply tank via fluid transport tubes to the fluid discharge outlet, and the heating element is operable to heat the fluid prior to it being discharged from the fluid discharge outlet. A single switch device is configured to control operation of the vacuum fan, water pump and heating element.

18 Claims, 4 Drawing Sheets

U.S. PATENT DOCUMENTS

| | | | | |
|---|---|---|---|---|
| 4,821,366 | A | | 4/1989 | Levine |
| 4,831,685 | A | | 5/1989 | Bosyj et al. |
| RE33,074 | E | | 10/1989 | Levine |
| 4,896,396 | A | | 1/1990 | Giannelli |
| 4,920,608 | A | | 5/1990 | Hult et al. |
| 4,928,347 | A | | 5/1990 | Krasznai et al. |
| D313,831 | S | | 1/1991 | Gildersleeve |
| 5,020,187 | A | | 6/1991 | Kosten et al. |
| 5,065,473 | A | | 11/1991 | Krasznai et al. |
| D333,891 | S | | 3/1993 | Reed, Jr. et al. |
| 5,289,610 | A | | 3/1994 | Monson |
| 5,341,541 | A | | 8/1994 | Sham |
| D352,807 | S | | 11/1994 | Sanderud |
| 5,367,740 | A | | 11/1994 | McCray |
| 5,383,251 | A | | 1/1995 | Whitaker et al. |
| D357,772 | S | | 4/1995 | Yuen |
| 5,473,792 | A | | 12/1995 | Kent et al. |
| 5,500,977 | A | | 3/1996 | McAllise et al. |
| 5,507,068 | A | | 4/1996 | Fan et al. |
| 5,680,810 | A | | 10/1997 | Sham |
| 5,692,315 | A | | 12/1997 | Sham |
| 5,784,753 | A | | 7/1998 | Kaczmarz et al. |
| 5,784,755 | A | | 7/1998 | Karr et al. |
| 5,794,303 | A | | 8/1998 | Sanfilippo et al. |
| 5,819,364 | A | | 10/1998 | Sham |
| 5,839,159 | A | | 11/1998 | Karr et al. |
| 5,865,104 | A | | 2/1999 | Sham et al. |
| 5,896,617 | A | | 4/1999 | Kasen et al. |
| 5,958,113 | A | | 9/1999 | Collins et al. |
| 5,970,572 | A | | 10/1999 | Thomas |
| 6,031,969 | A | | 2/2000 | Burr et al. |
| D425,270 | S | | 5/2000 | Zahuranec |
| D430,365 | S | | 8/2000 | Roberts et al. |
| 6,100,502 | A | | 8/2000 | Sham et al. |
| 6,125,498 | A | | 10/2000 | Roberts et al. |
| 6,148,144 | A | | 11/2000 | Milanese |
| 6,189,178 | B1 | | 2/2001 | Roberts |
| 6,212,332 | B1 | | 4/2001 | Sham et al. |
| D441,508 | S | | 5/2001 | Doria |
| D445,974 | S | | 7/2001 | Stratford |
| 6,289,551 | B1 | | 9/2001 | Basile |
| 6,314,972 | B1 | | 11/2001 | Sin |
| 6,490,753 | B1 | * | 12/2002 | Chen ..... 15/320 |
| 6,571,421 | B1 | * | 6/2003 | Sham et al. ..... 15/320 |
| 2001/0039684 | A1 | | 11/2001 | Kasper et al. |
| 2003/0106180 | A1 | * | 6/2003 | Tsen ..... 15/321 |

* cited by examiner

HAND HELD STEAM VACUUM WITH SINGLE SWITCH OPERATION

FIELD OF THE INVENTION

The present invention relates to hand held steam vacuums. More particularly, the present invention relates to a hand held steam vacuum that is operated by way of a single switch device.

BACKGROUND OF THE INVENTION

Hand held vacuums which utilize a fluid, such as a liquid cleaning fluid or steam, to enhance cleaning are known. Operation of such vacuums is typically carried out via at least two separate and independent switches: a heater switch and a main function switch. The heater switch may be a rocker type switch for controlling the heater. The heater switch has two switch positions, heater "On" and heater "Off." The main function switch is a four position slider switch having four different switch positions: "Spray," "Steam," "Off," and "Vacuum." When the function switch is at the "Vacuum" position, only the vacuum motor operates. When the function switch is at the "Steam" position, the water pump operates at a low speed. When the function switch is at the "Spray" position, the water pump operates at a high speed. When the function switch is at the "Off" position, the vacuum motor and water pump are deactivated.

Operation of a hand held vacuum using the two switch configuration described above is extremely cumbersome and may result in damage to the item being cleaned. For example, if the user fails to switch the heater to the "On" position before actuating the main function switch to either the "Steam" position or the "Spray" position, the vacuum will discharge cold water onto the item being cleaned, thereby possibly causing damage to the item.

In addition, the two switch configuration may lead to other problems. Due to the independent operation of the two switches, it is conceivable that the heater may be inadvertently left on. For instance, the operator may slide the main function switch to the "Off" position, and yet fail to turn off the heater. Leaving the heater on for a prolonged period of time may damage the heater and possibly shorten the life of the heater and components of the vacuum associated with the heater. Consequently, a need exists in the art to develop a hand held steam vacuum that eliminates the possibility of producing a cold water spray when steam is desired and only allows the heater to be energized when used in the "Steam" and "Spray" modes of operation.

SUMMARY OF THE INVENTION

In accordance with the present invention, a hand held steam vacuum is provided that uses fluid, such as water, to enhance the cleaning of a surface. The vacuum includes a pump to drive the water through fluid transport tubes to a fluid discharge aperture. Before reaching the fluid discharge aperture, the fluid transport tubes direct the water near a heater that heats the water to produce water vapor that is released from the vacuum. The operation of the water pump and heater is controlled by a single switch device preferably having four switch position: vacuum, off, steam, and spray.

When the switch is placed at the vacuum position, a vacuum fan is activated, but a heater and water pump remain in an inactivated state. When switch is placed in the steam position, the heater is activated and the water pump pumps at a first pumping rate, but the vacuum fan is deactivated.

When the switch is placed in the spray position, the heater remains activated and water is pumped by the water pump at a second pumping rate that is different from the first pumping rate. When the switch is placed in the off position, all of the functions are deactivated.

The use of a single control device to operate the hand held vacuum is advantageous as it prevents the user from accidentally causing damage to the item being cleaned. For example, the use of a single control device makes it impossible to activate the pump without also activating the heater, thus eliminating the possibility of ejecting cold water upon the surface being cleaned due to the operator's failure to activate the heater in conjunction with the pump. Further, the use of a single control device does not allow the heater to remain energized once the steam or spray operations have ceased.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE PREFERRED EMBODIMENTS

The following description of the preferred embodiment(s) is merely exemplary in nature and is in no way intended to limit the invention, its application, or uses. For example, although the invention is discussed herein in terms of a hand held vacuum that is capable of cleaning a surface using steam generated by heating water, the vacuum may also be configured to clean a surface using other fluids that enhance cleaning.

Figure 1:
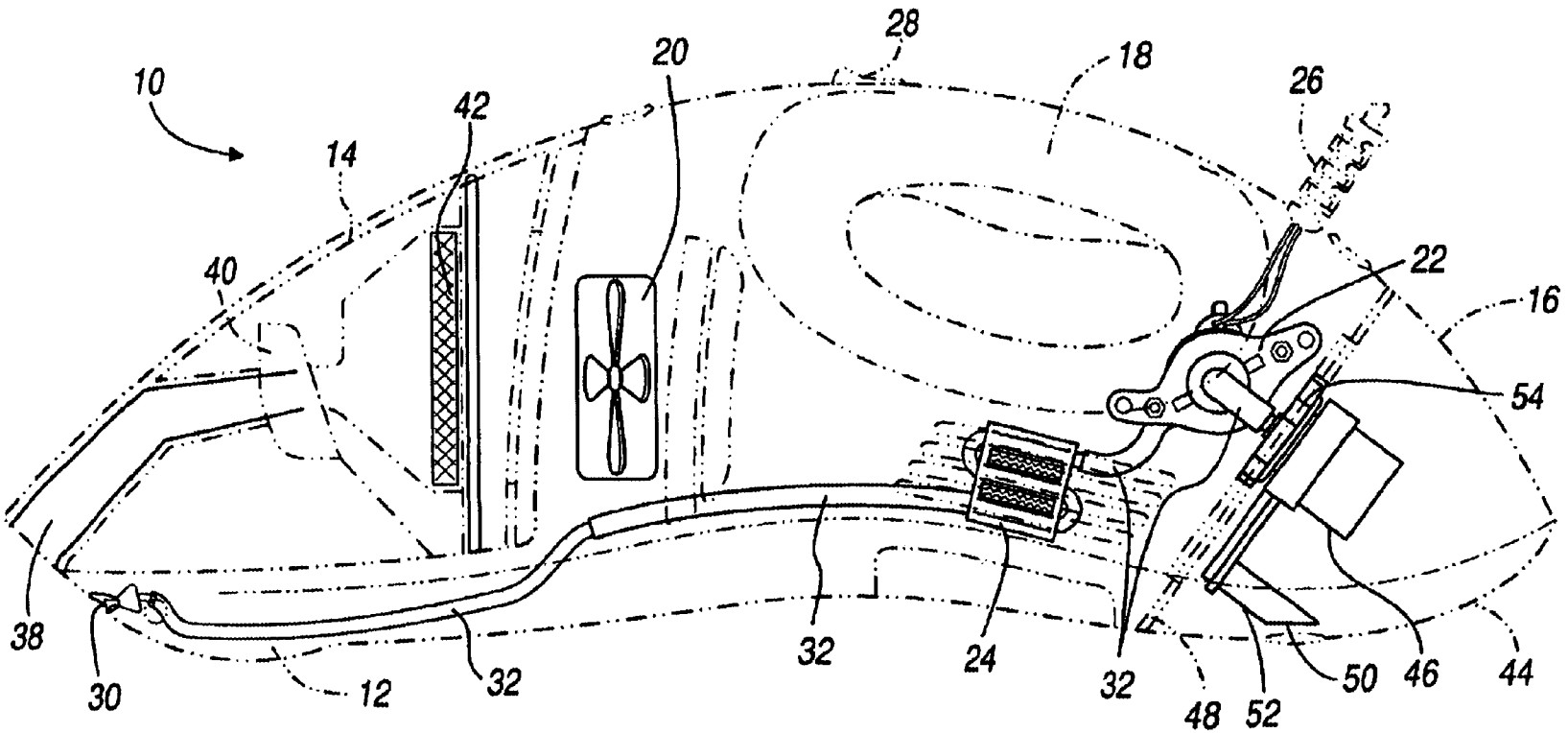
FIG. 1 is a perspective view depicting an exemplary hand held steam vacuum in accordance with the present invention.

Referring to FIG. 1, a preferred embodiment of a hand held steam vacuum, generally indicated at 10, is illustrated. Hand held steam vacuum 10 generally includes a main body housing 12 to which a collection bowl 14 and a fluid supply tank 16 are removably attached. Housing 12 includes a handle 18 for carrying and manipulating hand held steam vacuum 10. Internal to the housing 12 is a fan 20, a pump mechanism 22, and a heating mechanism 24. Fan 20, pump 22, and heating mechanism 24 are all electrically connected to power supply cord 26 and are operated using a single switch 28. Fluid is pumped by the pump mechanism 22 from the fluid supply tank 16 through the heating mechanism 24 and out through discharge apertures 30 via fluid transport tubes 32. Heating mechanism 24 is adapted to heat at least a portion of the fluid flowing from the supply tank 16 to the discharge apertures 30 into steam.

The debris collection bowl 14 is removably attached to the housing 12 and includes a vacuum inlet 38, a deflector 40, and a filter mechanism 42. During operation, fan 20 sucks air, fluid and debris into collection bowl 14 through vacuum inlet 38. The incoming materials impact upon deflector 40 which generally separates the fluid and debris from the air that passes through the filter mechanism 42 and out of the housing 12.

Figure 2:
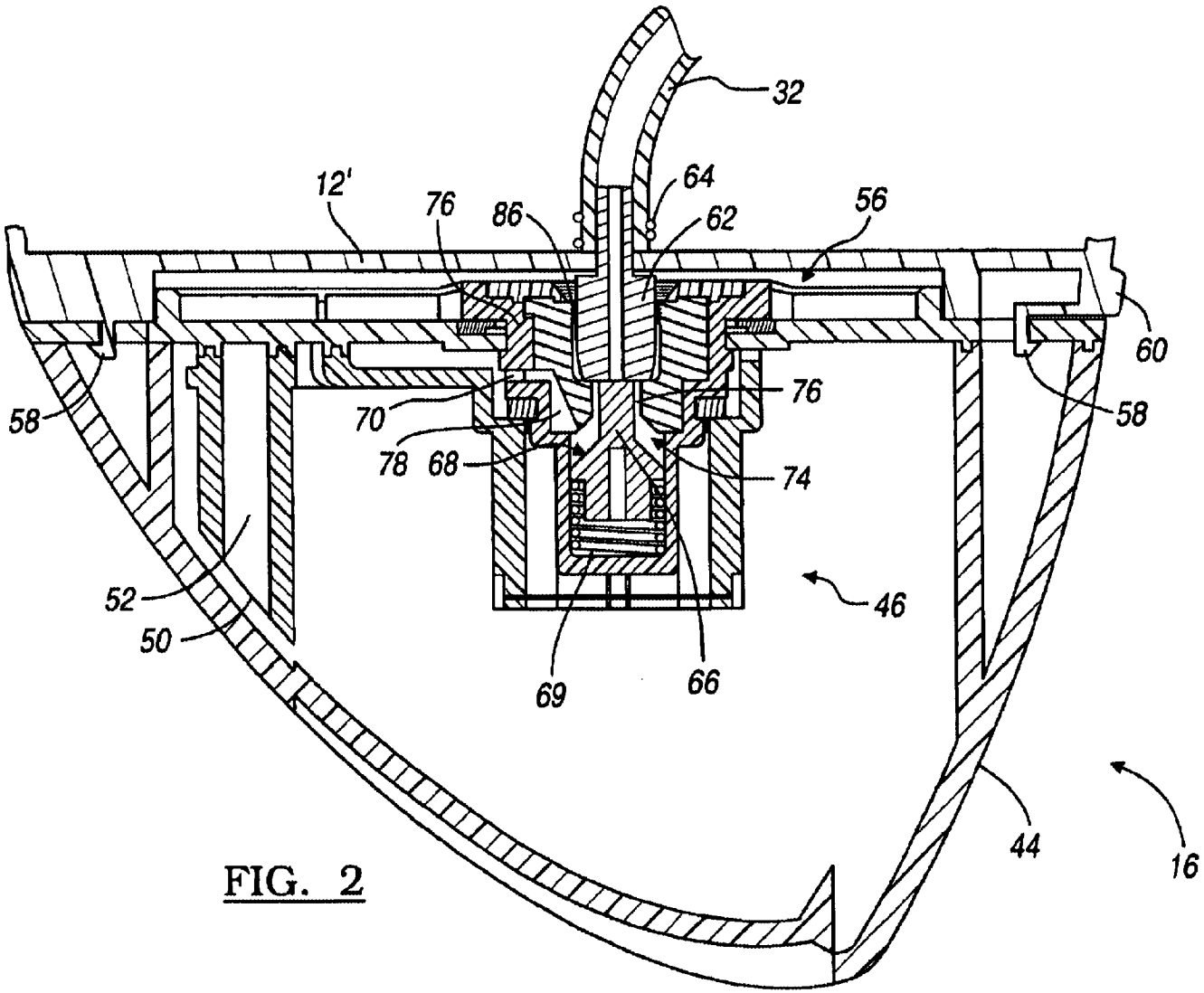
FIG. 2 is a cross-sectional view of a fluid supply tank employed by the of the hand held steam vacuum of the present invention.

Referring to FIGS. 1 and 2, the fluid supply tank 16 generally includes a container member 44, an internal rigid member 46, and a lid member 48. Internal rigid member 46 is fixedly attached to the inside surface of lid member 48. Thus, a fluid passage is provided from a distal end 50 of a rigid flow path extension 52 to a point adjacent fill opening 54 of the fluid supply tank 16. Fill opening 54 is sealed by a closure 56.

Referring to FIG. 2, the fluid supply tank 16 is illustrated attached to the housing 12 of the hand held vacuum 10. The housing includes mating wall 12' which includes locking tabs 58. Locking tab 58 is cantilevered from the mating wall 12' and includes a pushbutton 60 which when manually pressed releases fluid supply tank 16 from the housing 12. Thus, the fluid supply tank 16 is removably connected to main body housing 12 and may be selectively located in position attached to the housing 12 or in an unattached position.

Attached to mating wall 12' is fluid transport tube 32 and coupling member 62 which are retained together by compression banding 64. As fluid supply tank 16 is attached to housing 12, coupling member 62 protrudes into closure 56. As coupling member 62 continues to protrude into closure 56, it contacts valve member 66 and opens valve mechanism 68 against the force of biasing member 69. Thus, attachment of fluid supply tank 16 to main body housing 12 causes coupling member 62 to move valve mechanism 68 into an open position.

The distal end 50 of the rigid flow path extension 52 is located in the area which is a low point within the fluid supply tank 16 during normal operation of the hand held steam vacuum 10. Under influence of pump mechanism 22, fluid is a sucked from the distal end 50 of the flow path extension 52 to radial inlet 70. Next, fluid passes through the discharge flow path 74 which extends between radial inlet 70 and axial outlet 76 via the bottom segment of recess 78 and past valve mechanism 68. Coupling member 62 relieves fluid exiting discharge flow path 74 of closure 56 and transfers fluid to pump mechanism 22 via fluid transport tube 32. Under influence of pump mechanism 22, the fluid then passes through fluid transport tubes 32 to heating mechanism 24.

Figure 3:
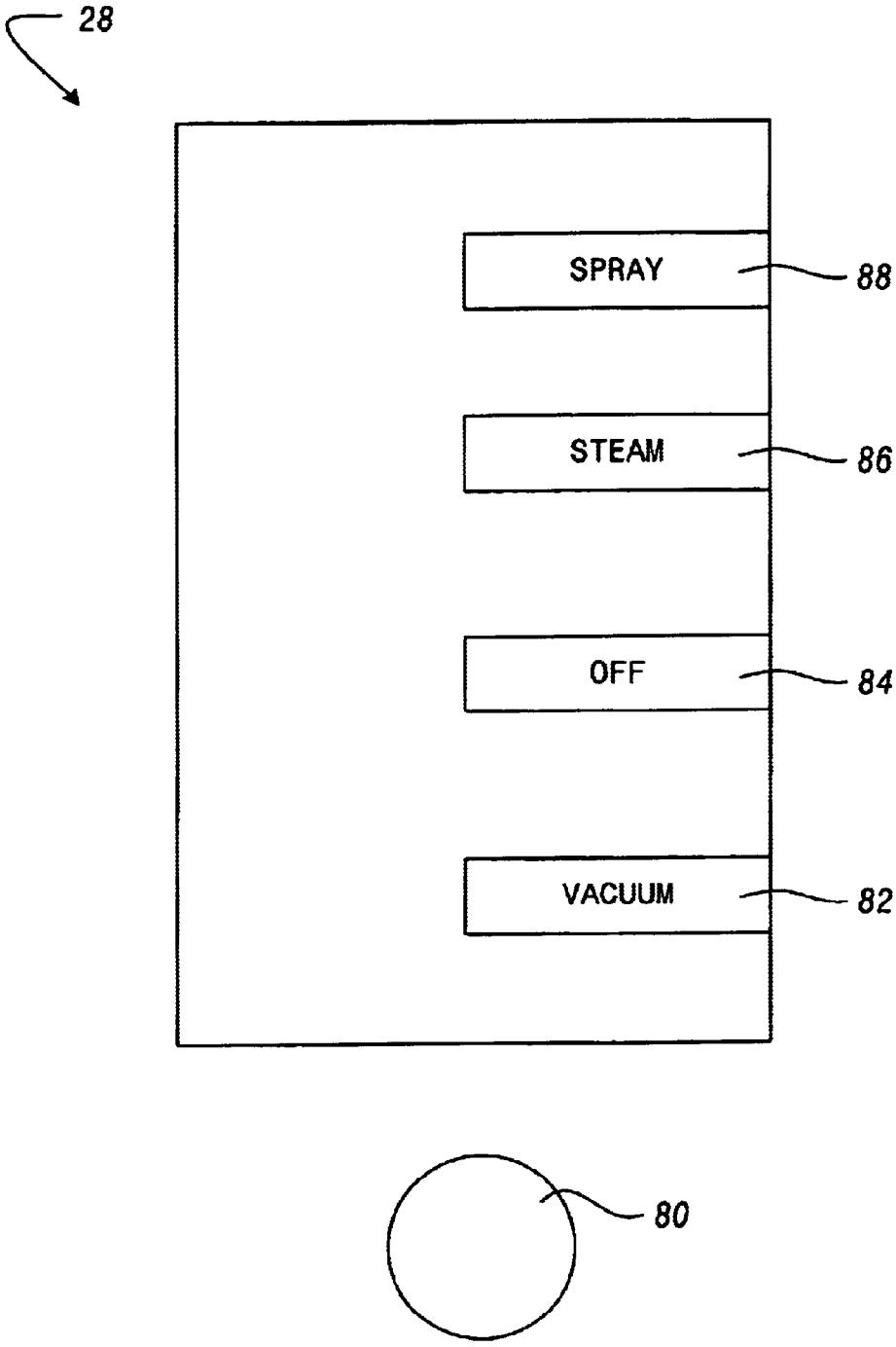
FIG. 3 is diagram illustrating switch positions for an exemplary switch device employed by the hand held steam vacuum of the present invention.

In operation, a control device, such as a slide type switch 28, is used to select the mode of operation for the vacuum 10. Referring to FIG. 3, the switch 28 may take the form of a four position slide switch. Each of the switch positions represent a different mode of operation which may be activated by the switch 28. In particular, the switch 28 provides a "vacuum" position 82, an "off" position 84, a "steam" position 86, and a "spray" position 88. The control device for the vacuum 10 may also include a visual indicator 80, such as a LED, which illuminates during certain modes of operation. In particular, the visual indicator indicates when the heater is energized. The operation of the vacuum is further described below. While the following description is provided to reference to a particular switch configuration, it is readily understood that other switch functions as well as other types of switches are within the broader aspects of the present invention.

Initially, the switch 28 is in an "Off" position, thereby indicating the vacuum is in an inactive state. When the switch 28 is set to the "Vacuum" position 82, the vacuum fan 20 will be activated so as to suck debris into collection bowl 14 through vacuum inlet 38. However, the pump 22 and the heater 24 remain off. Similarly, the visual indicator 80 is not illuminated when the switch is set to the "Vacuum" position. When the switch 28 is placed in the "Steam" position 86, the pump 22 and the heater 24 are activated; whereas the vacuum fan 20 is deactivated. More specifically, the pump 22 is operated at a first pump speed. Since the heater 24 is on, the visual indicator 80 is also illuminated. It is important to note that the heater was not activated through the use of an independent switch mechanism. Likewise, when the switch 28 is placed in the "Spray" position, the pump 22 and the heater 24 are activated; whereas the vacuum fan 20 remains deactivated. In this case, the pump is operated at a second pump speed that is preferably faster than the first pump speed in the "Steam" position. Again, the visual indicator is illuminated to indicate that the heater 24 is on. If the switch is slid from the "Spray" position to the "Steam" position, the pump 22 will operate at the first pump speed and the heater and visual indicator will remain on. Lastly, if the switch is moved back to the "Off" position, all of the functions will be terminated.

In the steam mode or spray mode of operation, it is readily understood that the water pump 22 does not operate at a constant rate but rather operates at a variable rate. To control the pump rate, the vacuum 10 further includes a pump flow rate control circuit. A schematic of a preferred pump flow rate control circuit 90 is provided in FIG. 4. The flow rate control circuit 90 is primarily comprised of a timing circuit which is disposed between the switch 28 and the water pump 22. In the preferred embodiment, a D-type flip-flop circuit 92 provides the pump rate signal to the pump. It is readily understood that additional circuitry may be needed to operate the vacuum fan 20. Moreover, it is readily understood that other configurations for the control circuit are also within the broader aspects of the present invention.

Figure 4:
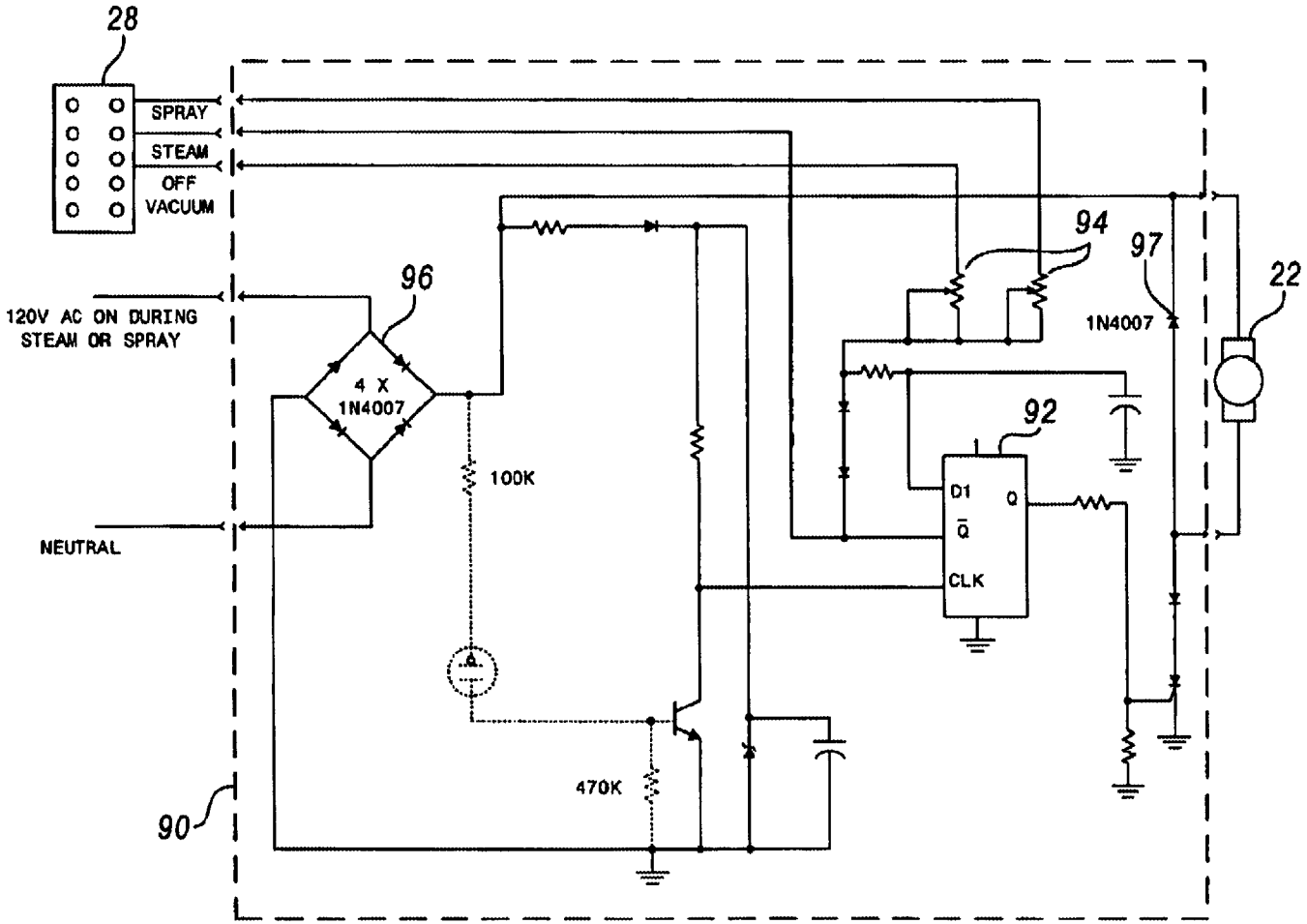
FIG. 4 is a schematic of an exemplary pump flow rate control circuit used by the hand held steam vacuum of the present invention.

In operation, two potentiometers 94 may be used by the operator to manually adjust the set point value for the timing circuit, thereby dictating the pump rate. In the preferred embodiment, the clock signal for the timing circuit is derived from the AC power signal input into the vacuum. Since the frequency of a typical AC power signal is 60 hertz, it is readily understood that the pump rate may be set to within 16.7 milliseconds of the desired pump rate. To improve the accuracy of the desired pump rate setting, the flow rate circuit 90 of the present invention introduces a full wave rectifier 96 as shown in FIG. 4. The full wave rectifier 96 effectively doubles the frequency of the clock signal input into the timing circuit, thereby enabling the pump rate to be set within 8.3 milliseconds of the desired pump rate. To absorb the inductance associated with the pump, a diode 97 may be connected across the pump 22 as shown in FIG. 4.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A hand held steam vacuum comprising:

a fluid discharge outlet;

a fluid supply tank in fluid communication with the fluid discharge outlet;

a pump connected to the fluid supply tank and operable to drive fluid from the fluid supply tank to the fluid discharge outlet;

a heating element operable to heat the fluid prior to the fluid being discharged from the fluid discharge outlet;

a control device electrically connected to the pump and the heating element and configured to control operation of the pump and the heating element; and a control circuit electrically connected to the pump and operable to control a pump rate of the pump, the control circuit being configured to allow adjustment of the pump rate to a desired pump rate.

2. The hand held vacuum of claim 1 further comprising a vacuum fan, such that the control device is further configured to control operation of the vacuum fan.

3. The hand held vacuum of claim 2 wherein the control device is further defined as a switch having four switch positions.

4. The hand held vacuum of claim 3 wherein the vacuum fan is activated when the switch is set to a first switch position.

5. The hand held vacuum of claim 3 wherein the pump and heating element are activated when the switch is set to a second switch position, such that the pump is operating at a first pump rate.

6. The hand held vacuum of claim 5 wherein the pump and heating element are activated when the switch is set to a third switch position, such that the pump is operating at a second pump rate which is different than the first pump rate.

7. The hand held vacuum of claim 3 wherein the vacuum fan, the pump and heating element are deactivated when the switch is set to a fourth switch position.

8. The hand held vacuum of claim 1 further comprising a visual indicator that illuminates when the heating element is activated.

9. The hand held vacuum of claim 1 wherein the fluid is further defined as liquid water, such that the heating element converts at least a portion of the liquid water to a water vapor.

10. The hand held vacuum of claim 1 wherein the fluid supply tank is in fluid communication with the fluid discharge outlet by way of at least one fluid transport tube.

11. The hand held vacuum of claim 10 wherein the heating element is located in close proximity to the at least one fluid transport tube.

12. The hand held vacuum of claim 1 wherein the control circuit is operable to derive a clock signal from a power signal input into the vacuum, such that the control circuit includes a full wave rectifier for doubling the frequency of the power signal, thereby enabling a more accurate setting of the desired pump rate.

13. A method for operating a hand held steam vacuum using a single switch device having four switch positions, comprising:

activating a vacuum fan associated with the vacuum when the switch device is set to a first switch position;

activating a pump and a heating element which are both associated with the vacuum when the switch device is set to a second switch position, such that the pump is operating at a first pump rate;

activating the pump and the heating element when the switch device is set to a third switch position, such that the pump is operating a second pump rate which is different than the first pump rate; and deactivating the vacuum fan, the pump and the heating element when the switching device is set to a fourth switch position.

14. The method of claim 13 wherein the step of activating the vacuum fan further comprises deactivating the pump and the heating element.

15. The method of claim 13 wherein the step of activating the pump and the heating element when the switching device is set to either the second switch position or the third switch position further comprises deactivating the vacuum fan.

16. The method of claim 13 wherein the step of activating the heating element further comprises illuminating a visual indicator associated with the vacuum.

17. A hand held steam vacuum operated using a single switch device, the switch device having at least four switch positions comprising:

a vacuum position for activating a vacuum fan;

a first position for activating a pump and a heating element, such that the pump operates at a first pump rate; and a second position for activating the pump and the heating element, such that the pump operates at a second pump rate which is different than the first pump rate; and an off position for deactivating the vacuum fan, the pump, and the heating element.

18. The hand held vacuum of claim 17 further comprising a visual indicator, wherein the visual indicator is illuminated when the switch device is set to the first position or the second position.

* * * * *